US005290016A

United States Patent [19]

Elsner

[11] Patent Number: 5,290,016

[45] Date of Patent: Mar. 1, 1994

[54] ARRANGEMENT FOR COOLING VESSEL PORTIONS OF A FURNACE, IN PARTICULAR A METALLURGICAL FURNACE

[76] Inventor: Emil Elsner, Kiefernweg 10, Sinzham W-7573, Fed. Rep. of Germany

[21] Appl. No.: 934,749

[22] PCT Filed: Jan. 28, 1992

[86] PCT No.: PCT/EP92/00177

§ 371 Date: Dec. 7, 1992

§ 102(e) Date: Dec. 7, 1992

[87] PCT Pub. No.: WO92/14108

PCT Pub. Date: Aug. 20, 1992

[30] Foreign Application Priority Data

Jun. 2, 1991 [DE] Fed. Rep. of Germany ..... 4103508

[51] Int. Cl.[5] ..... F27D 1/12

[52] U.S. Cl. ..... 266/193; 266/190

[58] Field of Search ..... 266/190, 193, 194, 197

[56] References Cited

U.S. PATENT DOCUMENTS

| | | | |
|---|---|---|---|
| 628,790 | 7/1899 | Gaines et al. | 266/193 |
| 3,706,343 | 12/1972 | Saiga et al. | 165/70 |
| 4,119,792 | 10/1978 | Elsner et al. | 13/32 |
| 4,273,949 | 6/1981 | Fischer et al. | 13/35 |
| 4,410,999 | 10/1983 | Wabersich et al. | 373/76 |
| 4,494,594 | 1/1985 | Kurzinski | 164/443 |
| 4,715,042 | 12/1987 | Heggart et al. | 373/74 |
| 4,813,055 | 3/1989 | Heggart et al. | 373/74 |
| 4,815,096 | 3/1989 | Burwell | 373/74 |

FOREIGN PATENT DOCUMENTS

| | | |
|---|---|---|
| 0044512 | 1/1982 | European Pat. Off. . |
| 0197137 | 4/1986 | European Pat. Off. . |
| 0335042 | 10/1989 | European Pat. Off. . |
| 2659827 | 4/1978 | Fed. Rep. of Germany . |
| 2817869 | 10/1979 | Fed. Rep. of Germany . |
| 3027464 | 7/1982 | Fed. Rep. of Germany . |
| 3820448 | 12/1989 | Fed. Rep. of Germany . |
| 2064079 | 6/1981 | United Kingdom . |

OTHER PUBLICATIONS

Ameling et al. "Water-cooled sidewall elements in UHP arc furnaces" Stahl u. Eisen vol. 98 No. 9, pp. 429–434; (Dec. 1978).

*Primary Examiner*—Scott Kastler

*Attorney, Agent, or Firm*—Lahive & Cockfield

[57] ABSTRACT

An arrangement for cooling vessel portions of a furnace (1) having a cooling box which is fitted into a wall or cover region to be cooled or which forms a wall or cover region and which, towards the furnace interior (6), includes a heat exchange plate (2) which is acted upon with cooling fluid through a plurality of spray nozzles (3). The heat exchange plate (2) is in the form of a composite plate comprising a steel plate (8) on the side towards the furnace interior (6) and a copper layer (9) on the side of the spray nozzles.

11 Claims, 1 Drawing Sheet

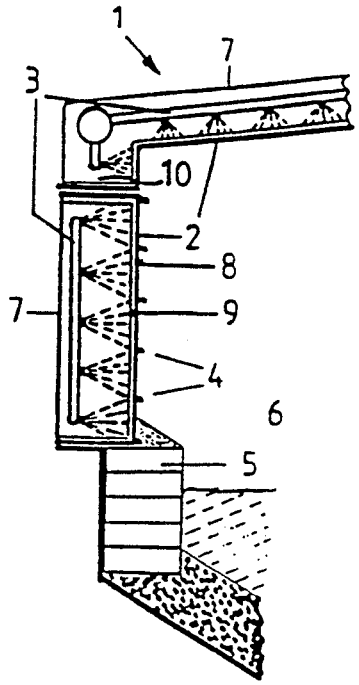
FIG. 1
FIG. 2
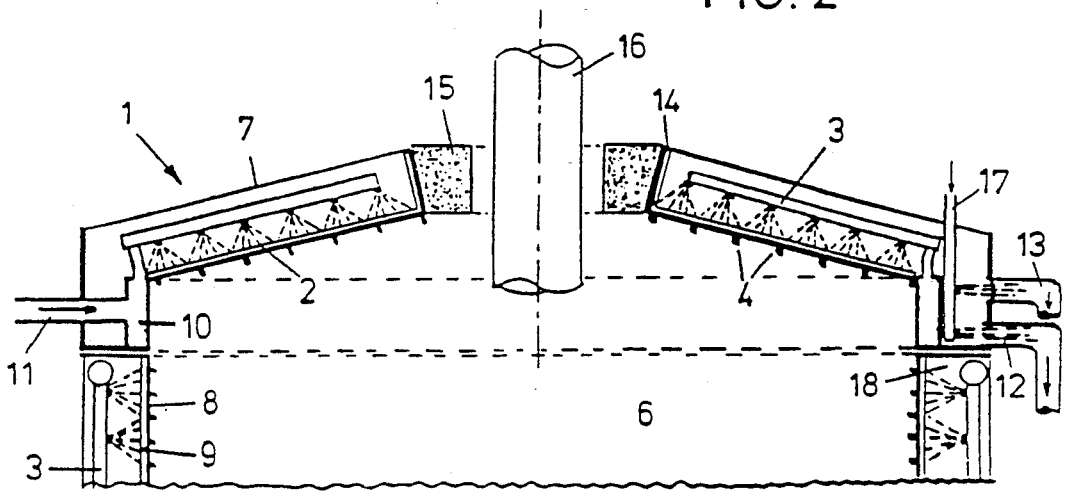

ARRANGEMENT FOR COOLING VESSEL PORTIONS OF A FURNACE, IN PARTICULAR A METALLURGICAL FURNACE

The invention concerns an arrangement for cooling vessel portions of a furnace, in particular a metallurgical furnace, comprising a cooling box which is fitted into a wall or cover region to be cooled or which forms a wall or cover region and which, towards the interior of the furnace, has a heat exchange plate and, in opposite relationship thereto and spatially distributed, a plurality of spray nozzles for spraying a cooling fluid onto the heat exchange plate, and also an outlet for the cooling fluid.

An arrangement of that kind with a steel plate as the heat exchange plate is known for example from EP 0 044 512 A1 or EP 0 197 137 B1. In the arrangement described in the first-mentioned specification, individual or group-wise control of the spray times of the nozzles means that the amount of cooling fluid which is sprayed against the heat exchange plate is only such that the sprayed cooling fluid is essentially evaporated and thus the enthalpy of evaporation is utilised to give the cooling action. In the other arrangement, the amount of cooling fluid sprayed against the heat exchange plate is such that it still remains substantially in its liquid form. In that case the coolant consumption is substantially higher than in the first-mentioned case.

Besides spray cooling, it is also known for example from DE 26 59 827 B1, DE 28 17 869 B2 and DE 38 20 448 A1, in relation to cooled wall or cover elements for metallurgical furnaces, for the heat to be removed from the heat exchange surface of the cooling elements by way of a forced cooling water flow. Particularly in the case of furnaces in which the heat exchange plate is exposed to strong fluctuations in respect of time and location of the thermal loading involved, such cooling water systems require a substantially larger amount of cooling fluid than spray-cooled systems in order to prevent a film boiling phenomenon, that is to say, the occurrence of thin insulating layers of vapour at locations on the heat exchange surface which are subjected to a heavy thermal loading. That effect would result in damage to the cooling element in that region.

DE 38 20 448 A1 describes inter alia a cooled wall element for metallurgical furnaces, in particular electric arc furnaces, which includes a steel plate which is provided on one side with a plating of copper or a copper alloy and which, on the surface remote from the plating, is fitted with shaped metal members forming coolant ducts. The layer of copper on the side of the wall element which is towards the inside, by virtue of the high level of thermal conductivity of copper, is intended to provide for very rapid transmission of the heat received, uniform distribution of the heat and rapid removal of the heat so as to prevent material damage, even in the event of local overheating occurring. In addition, the layer of copper which is preferably applied in a thickness of between 6 and 10 mm remains ductile and prevents the formation of cracking in the wall of the cooling element.

In the spray cooling systems which are set forth in the opening part of this specification and which are distinguished by a greatly reduced level of coolant consumption in comparison with cooling systems wit a forced cooling fluid flow, there is the problem that the dissipation of heat from the heat exchange plates does not take place uniformly. By virtue of the spatially distributed arrangement of individual spray nozzles and in addition the need which sometimes arises, for reasons of space, for individual nozzles to be arranged inclinedly, so that they only spray the cooling fluid against the heat exchange plate at an inclined angle, the heat exchange plate is acted upon by the coolant in an irregular fashion. The heat exchange plate is cooled to a substantially greater degree at the locations at which the cooling fluid is sprayed thereagainst, than in the regions therebetween. In order to prevent the admissible temperature being exceed at the locations which are less heavily cooled, it is necessary to operate with a larger total amount of coolant. In that respect, it is also necessary to take account of the thermal loading which is of a different magnitude in respect of time and location, as occurs for example when smelting scrap in an arc furnace.

The object of the invention, in an arrangement of the kind set forth in the opening part of this specification, is that of improving the cooling action, and reducing the overall amount of coolant required by a reduction in he temperature differences between the locations at which the cooling fluid is sprayed onto the heat exchange plate, and the regions therebetween. The invention further seeks to provide that the risk of local overheating in the event of any failure of individual nozzles is reduced and that, in the event of any cracking in the steel plate, the escape of coolant is prevented.

In the arrangement according to the invention the heat exchange plate, on the side of the spray nozzles, has a layer of a metal which has a substantially higher level of thermal conductivity than steel, preferably a layer of copper or a copper alloy, which, in spite of the non-uniform action of the coolant, which is caused by the cooling system, permits a comparatively uniform temperature profile over the heat exchange surface. That effect is surprisingly already achieved when the copper layer is between 1 and 2 mm in thickness. A substantial reduction in the amount of coolant is possible by virtue of the local temperature differences being reduced on the heat dissipation side of the heat exchange plate.

The following comparative tests were performed:

Using cooling boxes of the same design configuration and with the same thermal loading, the heat exchange plate used on the one hand was a steel plate of a thickness of 20 mm, on the other hand a steel plate of a thickness of 20 mm which was plated with a 6 mm thick copper layer on the side of the spray nozzles, and yet again a steel plate of a thickness of 20 mm, which was plated with a 2 mm thick copper layer. Thermocouple elements for ascertaining the temperature were fitted into the steel plate in the middle of the thickness of the steel plate at various measuring locations above and below the direct area of influence of the spray cooling. An amount of cooling water of 100 $l/m^2$ min, which is usual for spray cooling, was set, and the temperature at the measuring locations was detected. When using the steel plate, the worst temperature value was 99° C. while when using the steel plate plated with the copper layer, the worst temperature value was 83° C. (copper layer of 6 mm in thickness) and 82° C. (copper layer of 2 mm in thickness) respectively. Then, the amount of spray water was reduced in a stepwise manner using the heat exchange plate with the 2 mm thick copper layer until a temperature of 99° C. was also reached at the hottest measuring location, when using that heat exchange plate. The amount of cooling water was 70 $l/m^2$ min, that is to say, by virtue of the step according to the invention it was possible to save 30% of the amount of cooling water.

The composite plate is preferably produced by rolling, spraying and welding plating. Because of the small thickness of the layer, it is also possible for the metal layer with the higher level of thermal conductivity to be applied by spraying, brushing on or spreading or in some other fashion. It is also in accordance with the invention for only portions of the heat exchange plate to be provided with the layer with the improved thermal conductivity, or for that layer to be of locally varying thicknesses.

BRIEF DESCRIPTION OF THE DRAWINGS

The invention is described in greater detail by means of two embodiments with reference to two Figures of the diagrammatic drawings in which:

FIG. 1 is a vertical section through part of an arc furnace with arrangements for cooling vessel portions in accordance with this invention, FIG. 2 is the same view of an arc furnace with modified cover.

The arc furnace 1 shown in FIGS. 1 and 2 comprises in known manner a lower vessel with refractory lining, which accommodates the molten bath, a furnace wall which is fitted onto the edge of the lower vessel, and a cover which is fitted onto the furnace wall. The vessel structure of such a furnace is described for example in above-mentioned DE 26 59 827 B1 and in EP 0 197 137 B1. The wall and the cover are provided in known manner with a spray cooling system 3 which includes in spatially distributed array a plurality of spray nozzles for spraying a cooling fluid, preferably water, onto the heat exchange plate 2 of the cooling boxes, which is towards the furnace interior 6, and an outlet (not shown in FIG. 1) for the cooling fluid. The cooling fluid can be carried away by being pumped away, an increased pressure in the atmosphere of the cooling space or simple down pipes.

In the arrangement according to the invention he heat exchange plate 2 is in the form of a composite plate, comprising a steel plate 8 on the side which is towards the furnace interior and a copper layer 9, that is to say a layer of a material which has a substantially higher level of thermal conductivity than steel, on the side which is towards the spray nozzles. Reference numeral 4 identifies slag retainers for retaining heat-insulating splashes and spatters of slag, reference numeral 5 identifies the refractory lining and reference numeral 7 identifies the outer cover plate of the cooling boxes.

In the arc furnace shown in FIG. 1, the cover ring 10 is also spray-cooled. However, it may also be cooled by means of a conventional forced water circulation, as is shown in FIG. 2. The water of the forced circulation cooling system may represent a particular circuit, but, as shown in FIG. 2, it may also be used for spray cooling of the plate structure of the furnace cover.

To carry away the cooling fluid which is sprayed onto the heat exchange plates, use is made of one or more drains with down pipes, which are disposed at the lowest level of the cooling system at locations which afford good access. In the case of tiltable vessels and the covers which are connected thereto, the drain is on the tilting side or sides.

FIG. 2 shows the furnace cover of a tiltable arc furnace with a furnace cover ring 10 which is cooled by a forced circulation. The forced circulation serves at the same time as a feed for the spray cooling system 3. Reference numeral 11 identifies the intake of cooling water and reference numeral 12 identifies the cooling water outlet which is connected to a down pipe. Also arranged above the cooling water outlet 12 is a safety outlet 13 which is also connected to a down pipe. The heat exchange plates 2 of the cooled furnace cover and wall elements are in the form of composite plates. The heat exchange plate of the inner furnace cover ring 14 which accommodates the insert 15 of refractory material with passages for electrodes 16 also comprises a composite plate with a copper layer on the sides towards the spray nozzles. The inner furnace cover ring 14 can also be subjected to the action of spray water, if required.

Reference numeral 17 identifies a compressed air line having two nozzles through which compressed air can be blown into the cooling water outlet 12 and into the safety outlet 13 respectively, in order certainly to provide for discharge of cooling water under all circumstances, in particular also in the case of a tiltable vessel.

In the case of the furnace cover shown in FIG. 2, the inside surface of the cover is positioned higher than the upper edge 18 of the vessel, more specifically by the height of the furnace cover ring 10 with its forced cooling system. In that way, when the scrap smelting operation begins, the spacing of the inside surface of the furnace cover from the arc is increased and in addition the levelling operation when charging the vessel is made easier from the point of view of the operating crew.

I claim:

1. An arrangement for cooling vessel portions of a furnace comprising a cooling box which is fitted into a wall or cover region to be cooled or which forms a wall or cover region and which, towards the interior of the furnace, has a heat exchange plate and, in opposite relationship thereto and spatially distributed, a plurality of spray nozzles for spraying a cooling fluid onto the heat exchange plate, and also an outlet for the cooling fluid, wherein the heat exchange plate is in the form of a composite plate, with a steel plate on the side which is towards the furnace interior and, on the side towards the spray nozzles, a layer of metal which has substantially higher level of thermal conductivity than steel.

2. An arrangement according to claim 1 wherein the metal layer with the higher level of thermal conductivity has a greater degree of ductility than the steel plate.

3. An arrangement according to claim 1 wherein the metal layer with a higher level of thermal conductivity is of a thickness in the range of from 1 to 7 millimeters.

4. An arrangement according to claim 3 wherein the metal layer with a higher level of thermal conductivity is of a thickness in the range of from 2 to 3 millimeters.

5. An arrangement according to claim 1 wherein the metal layer with a higher level of thermal conductivity is a layer of copper or a copper alloy.

6. An arrangement according to claim 1 wherein the composite plate is produced by plating.

7. An arrangement according to claim 1 wherein the metal layer with the higher level of thermal conductivity is applied by spraying.

8. A cooling vessel portion of a furnace comprising a cooling box having a wall forming a heat exchange plate having one side exposed to an interior portion of said furnace and a plurality of spray nozzles for spraying a cooling fluid onto the opposite side of said heat exchange plate, wherein said heat exchange plate is a composite plate having a steel layer on said one side being exposed to the interior of said furnace and a layer of metal having a substantially higher level of thermal conductivity than steel on said opposite side exposed to said spray of said spray nozzles to promote uniform cooling of said heat exchange plate.

9. A cooling vessel portion of a furnace according to claim 8 wherein said layer of metal having a substantially higher level of thermal conductivity has a greater degree of ductility than the steel plate, whereby it resists cracking when the steel plate cracks.

10. A cooling vessel for cooling a furnace having a heat exchange plate means for forming a wall of said furnace, said heat exchange plate means including a first side exposed to an interior portion of said furnace and a second side, opposite said first side, exposed to a coolant spray, wherein said heat exchange plate means is composite plate comprising A. a base metal layer on said first side exposed to said interior portion of said furnace, and B. layer means, on said second side, having a substantially higher thermal conductivity than said base metal layer for producing uniform cooling of said heat exchange plate means.

11. A cooling vessel according to claim 10 wherein, said layer means includes means having a higher ductility than said base metal layer for resisting cracking when said base metal layer cracks.

* * * * *